US011181335B1

(12) United States Patent
McPherson et al.

(10) Patent No.: US 11,181,335 B1
(45) Date of Patent: Nov. 23, 2021

(54) ARCHERY BOW ACCESSORY BUSHING

(71) Applicant: MCP IP, LLC, Sparta, WI (US)

(72) Inventors: Mathew A. McPherson, Norwalk, WI (US); Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/020,552

(22) Filed: Sep. 14, 2020

(51) Int. Cl.
*F41B 5/14* (2006.01)

(52) U.S. Cl.
CPC ..... *F41B 5/1403* (2013.01); *F41B 5/1426* (2013.01)

(58) Field of Classification Search
CPC ..... F41B 5/14; F41B 5/1403; F41B 5/1426
USPC ..... 124/86, 88, 89
See application file for complete search history.

(56) References Cited

U.S. PATENT DOCUMENTS 3,412,725 A * 11/1968 Hoyt, Jr. ..... F41B 5/1426 124/84
3,524,441 A * 8/1970 Jeffery ..... F41B 5/1426 124/89
3,589,350 A * 6/1971 Hoyt, Jr. ..... F41B 5/1426 124/89
4,135,486 A * 1/1979 Enomoto ..... F41B 5/1426 124/89
4,570,608 A * 2/1986 Masterfield ..... F41B 5/1426 124/89
4,640,258 A * 2/1987 Penney ..... F21L 15/10 124/24.1
4,893,606 A * 1/1990 Sisko ..... F41B 5/1426 124/89
5,231,970 A * 8/1993 Ploot ..... F41B 5/10 124/23.1
5,297,533 A * 3/1994 Cook ..... F41B 5/14 124/23.1
5,339,793 A * 8/1994 Findley ..... F41B 5/1426 124/89
5,388,563 A * 2/1995 Hsu ..... F41B 5/1426 124/23.1
5,411,008 A * 5/1995 Hsu ..... F41B 5/0026 124/23.1
5,515,836 A * 5/1996 Martin ..... F41B 5/0026 124/23.1
5,558,078 A * 9/1996 Dunlap ..... F41B 5/1426 124/88
5,613,484 A * 3/1997 Troncoso ..... F41B 5/1426 124/86
5,660,158 A * 8/1997 Rudolph ..... F41B 5/0026 124/23.1
5,762,060 A * 6/1998 Larson ..... F41B 5/1426 124/23.1

(Continued)

*Primary Examiner* — Alexander R Niconovich
(74) *Attorney, Agent, or Firm* — Laabs Intellectual Property

(57) ABSTRACT

In some embodiments, an archery bow comprises a riser and a bushing attached to the riser. In some embodiments, the bushing comprises a flange and a tubular shaft. In some embodiments, the tubular shaft comprises an external helical thread and an internal helical thread. In some embodiments, the flange comprises a front portion and a rear portion, the rear portion comprising a rear surface in contact with the riser. In some embodiments, the front portion comprises a recessed portion and a contacting ring. In some embodiments, a diameter of the contacting ring is greater than a distance across the external helical thread.

18 Claims, 5 Drawing Sheets

(56) References Cited

U.S. PATENT DOCUMENTS 5,934,266 A * 8/1999 Martin ..... F41B 5/0031 124/88
5,944,004 A 8/1999 Goff et al.
6,076,514 A * 6/2000 Adams, Jr. ..... F41B 5/1426 124/89
6,244,259 B1 * 6/2001 Adkins ..... F41B 5/0026 124/23.1
6,499,478 B1 * 12/2002 Perez ..... F41B 5/14 124/25.6
6,543,432 B2 * 4/2003 Andrews ..... F41B 5/10 124/23.1
6,568,382 B2 * 5/2003 Martin ..... F16B 21/165 124/25.5
6,588,414 B2 * 7/2003 McMillan, III ..... F41B 5/1426 124/88
6,802,307 B2 * 10/2004 Leven ..... F41B 5/1426 124/89
7,036,497 B2 * 5/2006 Horn ..... F41B 5/14 124/86
7,958,881 B2 * 6/2011 Silverson ..... F41B 5/1426 124/86
8,408,195 B2 4/2013 McPherson
8,534,273 B2 * 9/2013 LoRocco ..... F41B 5/1426 124/89
9,046,317 B2 6/2015 McPherson
9,429,383 B2 * 8/2016 Martens ..... F41B 5/1426
9,759,510 B1 * 9/2017 Kempf ..... F41B 5/1426
9,909,833 B1 * 3/2018 Huang ..... F41B 5/1426
10,215,521 B1 * 2/2019 Huang ..... F41B 5/1426
10,648,762 B2 * 5/2020 Jonas, IV ..... F41B 5/1426
10,753,701 B2 * 8/2020 Jonas, IV ..... F41B 5/1426
10,816,304 B2 * 10/2020 McPherson ..... F41B 5/1426
2010/0313864 A1 12/2010 Gardner et al.
2010/0319669 A1 * 12/2010 Grace, Jr. ..... F41B 5/1426 124/88
2013/0160754 A1 * 6/2013 Dickman, Jr. ..... F41B 5/1426 124/89
2016/0061556 A1 * 3/2016 Armstrong ..... F41B 5/1426 124/89

* cited by examiner

ARCHERY BOW ACCESSORY BUSHING

BACKGROUND OF THE INVENTION

This invention relates generally to archery products and more specifically to attachment mechanisms for archery components.

Archery bows are generally known in the art. Archery bow accessories such as stabilizers are also known. It is often desirable for an accessory to attach to an archery bow with the most rigid connection possible.

There remains a need for novel structures that improve the performance of archery components.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser comprising a cavity and a bushing. In some embodiments, the bushing comprises a flange and a tubular shaft. In some embodiments, the tubular shaft extends into the cavity. In some embodiments, the tubular shaft comprises an internal helical thread. In some embodiments, the flange comprises a front portion and a rear portion. In some embodiments, the rear portion comprises a rear surface in contact with the riser. In some embodiments, the front portion comprises a contacting surface and a recessed portion. In some embodiments, the recessed portion is oriented between the tubular shaft and the contacting surface.

In some embodiments, the tubular shaft comprises an external helical thread that engages the cavity. In some embodiments, a distance across the recessed portion is greater than a distance across the external helical thread. In some embodiments, a diameter of the recessed portion is greater than a diameter of the external helical thread.

In some embodiments, the rear surface is parallel to the contacting surface.

In some embodiments, the rear portion comprises a rear recess oriented between the tubular shaft and the rear surface. In some embodiments, the rear recess is oriented opposite the recessed portion.

In some embodiments, the contacting surface comprising a ring. In some embodiments, an inner diameter of the ring is greater than a distance across the external helical thread.

In some embodiments, the flange comprises an outer sidewall oriented at an angle to the contacting surface. In some embodiments, the flange comprises a radiused edge oriented between the contacting surface and the outer sidewall. In some embodiments, the flange comprises a thickness and a radius of the radiused edge is less than half of the thickness.

In some embodiments, the recessed portion comprises a frustoconical surface.

In some embodiments, a radial dimension of the recessed portion is greater than a radial dimension of the contacting surface.

In some embodiments, an archery bow comprises a riser and a bushing attached to the riser. In some embodiments, the bushing comprises a flange and a tubular shaft. In some embodiments, the tubular shaft comprises an external helical thread and an internal helical thread. In some embodiments, the flange comprises a front portion and a rear portion, the rear portion comprising a rear surface in contact with the riser. In some embodiments, the front portion comprises a recessed portion and a contacting ring. In some embodiments, a diameter of the contacting ring is greater than a distance across the external helical thread.

In some embodiments, the recessed portion is oriented between the tubular shaft and the contacting ring.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
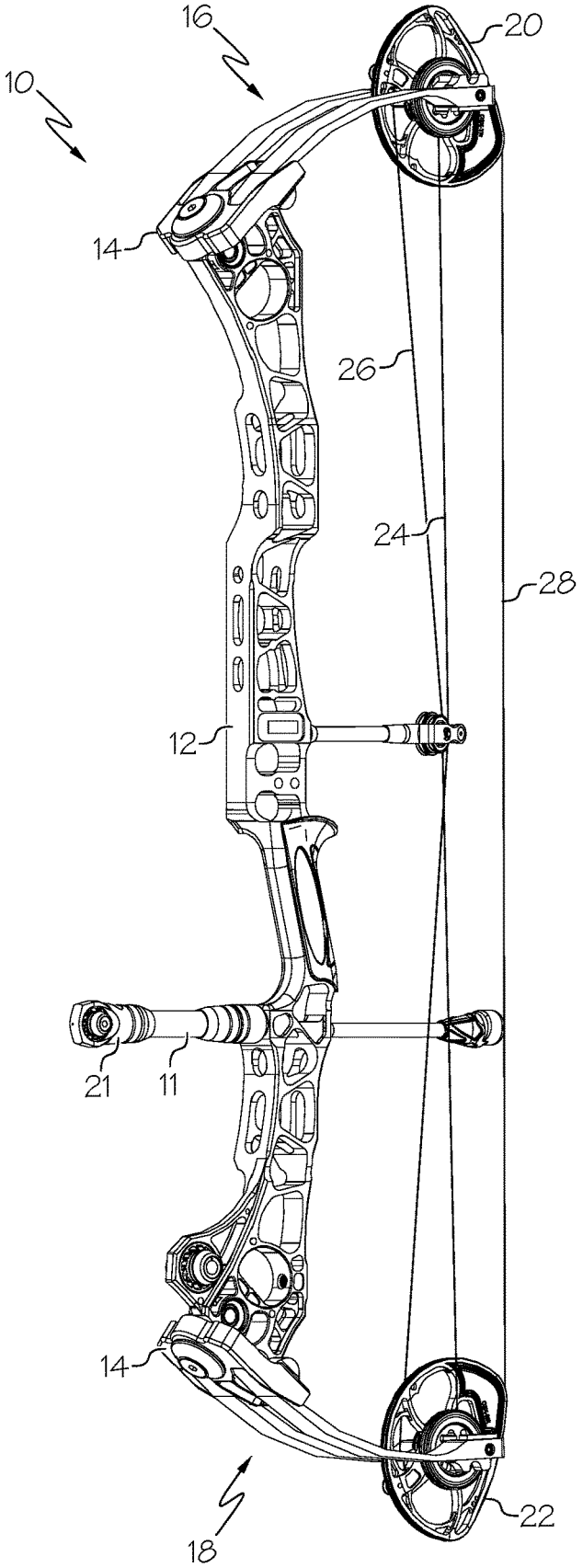
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 and an accessory 11 attached to the archery bow 10.

In some embodiments, an archery bow 10 comprises a riser 12, a first limb assembly 16 and a second limb assembly 18. In some embodiments, a limb cup 14 is used between the riser 12 and a limb assembly 16, 18. Desirably, a bowstring 28 extends between the limbs 16, 18.

In some embodiments, an archery bow 10 comprises a traditional, recurve or non-compound style archery bow.

In some embodiments, an archery bow 10 comprises a compound bow. In some embodiments, the first limb assembly 16 supports a first rotatable member 20 and the second limb assembly 18 supports a second rotatable member 22. In some embodiments, one or more of the rotatable members 20, 22 comprises a cam. In some embodiments, an archery bow 10 comprises a power cable 24 in communication with a cam. In some embodiments, an archery bow 10 comprises a second power cable 26 in communication with a second cam.

In some embodiments, an accessory 11 can comprise any suitable type of accessory arranged to attach to an archery bow 10. In some embodiments, an accessory 11 comprises a stabilizer 21.

Figure 2:
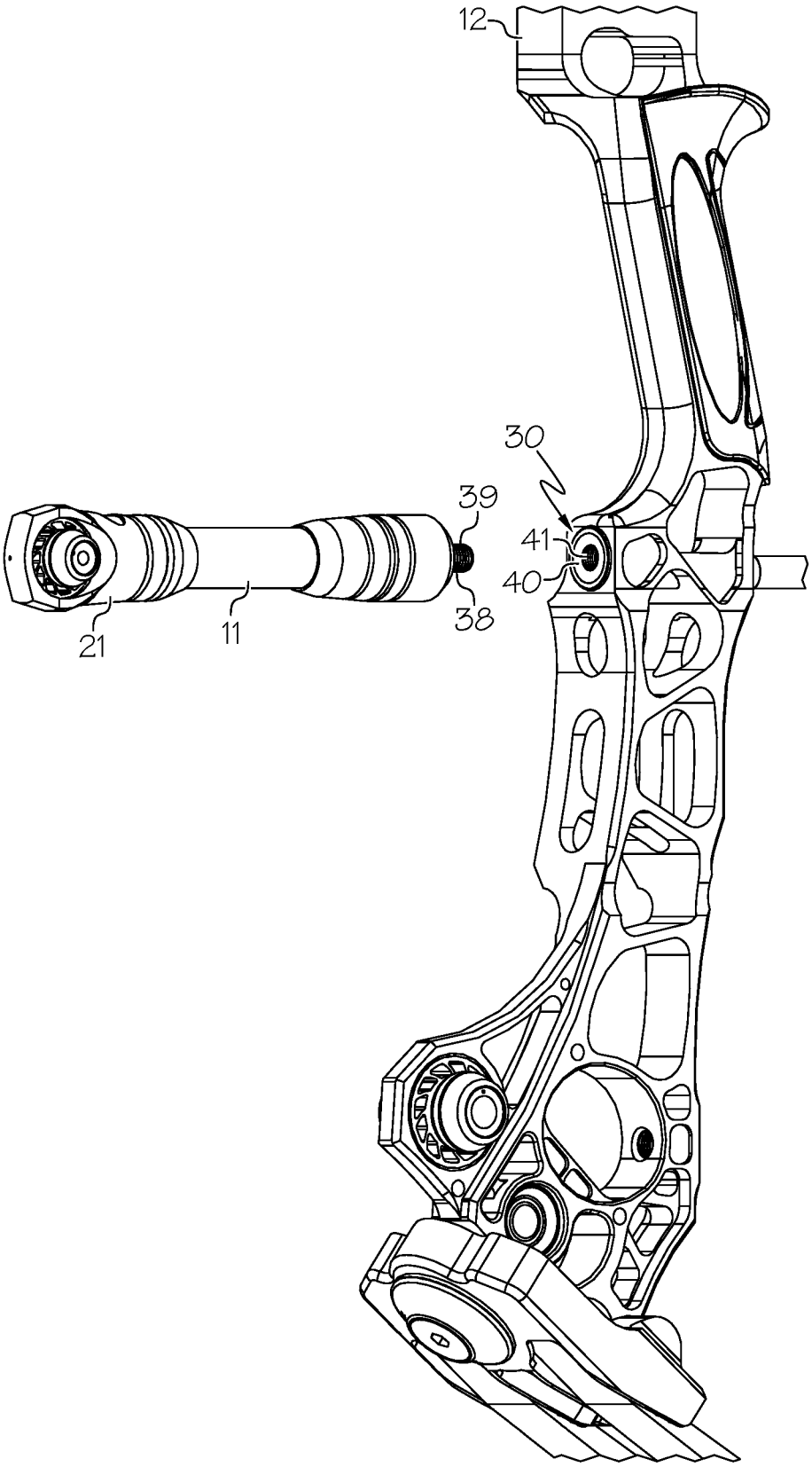
FIG. 2 shows a portion of the bow of FIG. 1 in greater detail and an accessory detached from the bow.

FIG. 2 shows a portion of the archery bow 10 of FIG. 1 in greater detail and shows the accessory 11 detached from the archery bow 10.

In some embodiments, the archery bow 10 supports a bushing 40. In some embodiments, the riser 12 supports the bushing 40. In some embodiments, the riser 12 comprises a cavity 30 and at least a portion of the bushing 40 is oriented in the cavity 30.

In some embodiments, the bushing 40 is arranged to engage the archery bow 10. In some embodiments, the bushing 40 is arranged to engage an accessory 11.

In some embodiments, an accessory 11 comprises a stud 38. In some embodiments, the stud 38 and the bushing 40 are constructed and arranged to engage one another. In some embodiments, the stud 38 comprises a threaded portion 39 arranged to engage a threaded portion 41 of the bushing 40.

In some embodiments, the bushing 40 is constructed and arranged to provide a stiffer connection between a riser 12 and an accessory 11 than was provided by prior connecting structures.

Figure 3:
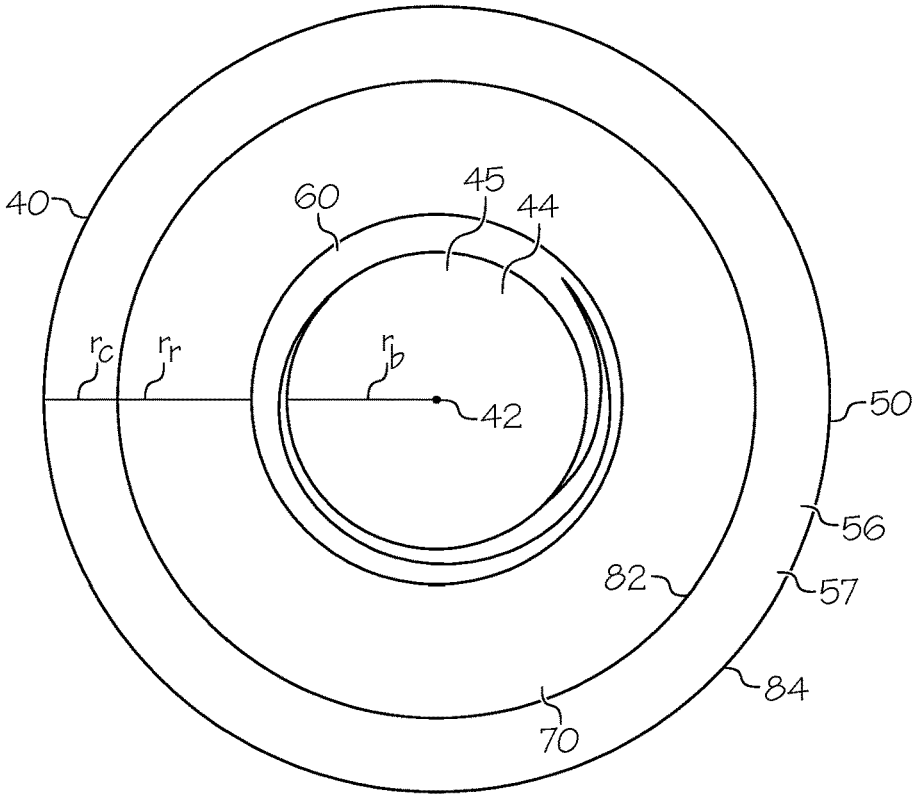
FIG. 3 shows a front view of an embodiment of a bushing.
Figure 4:
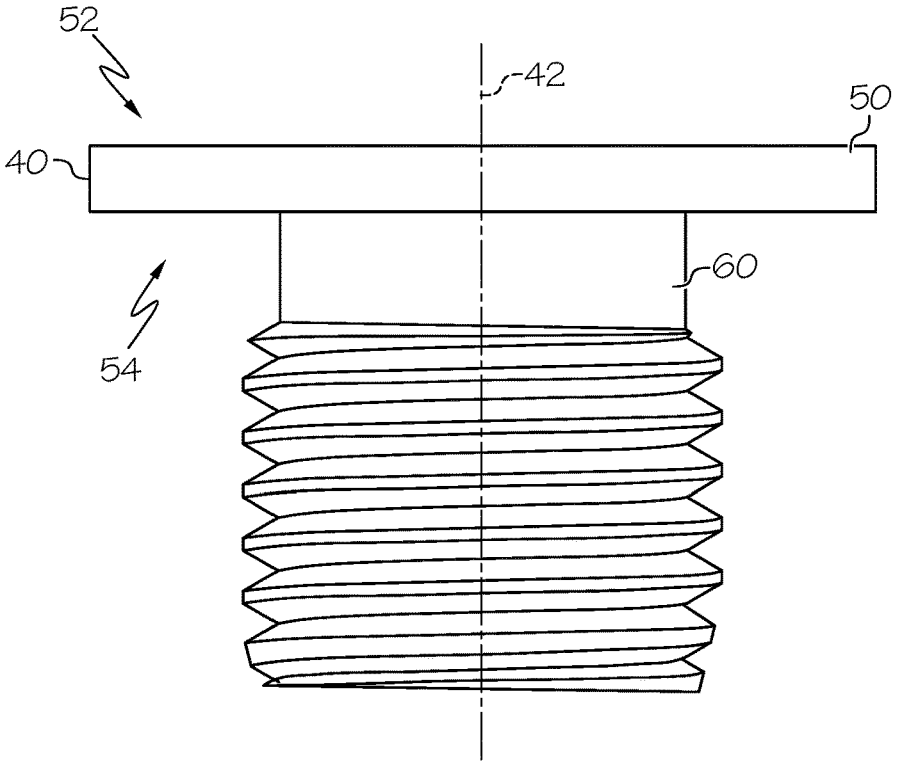
FIG. 4 shows a side view of an embodiment of a bushing.
Figure 5:
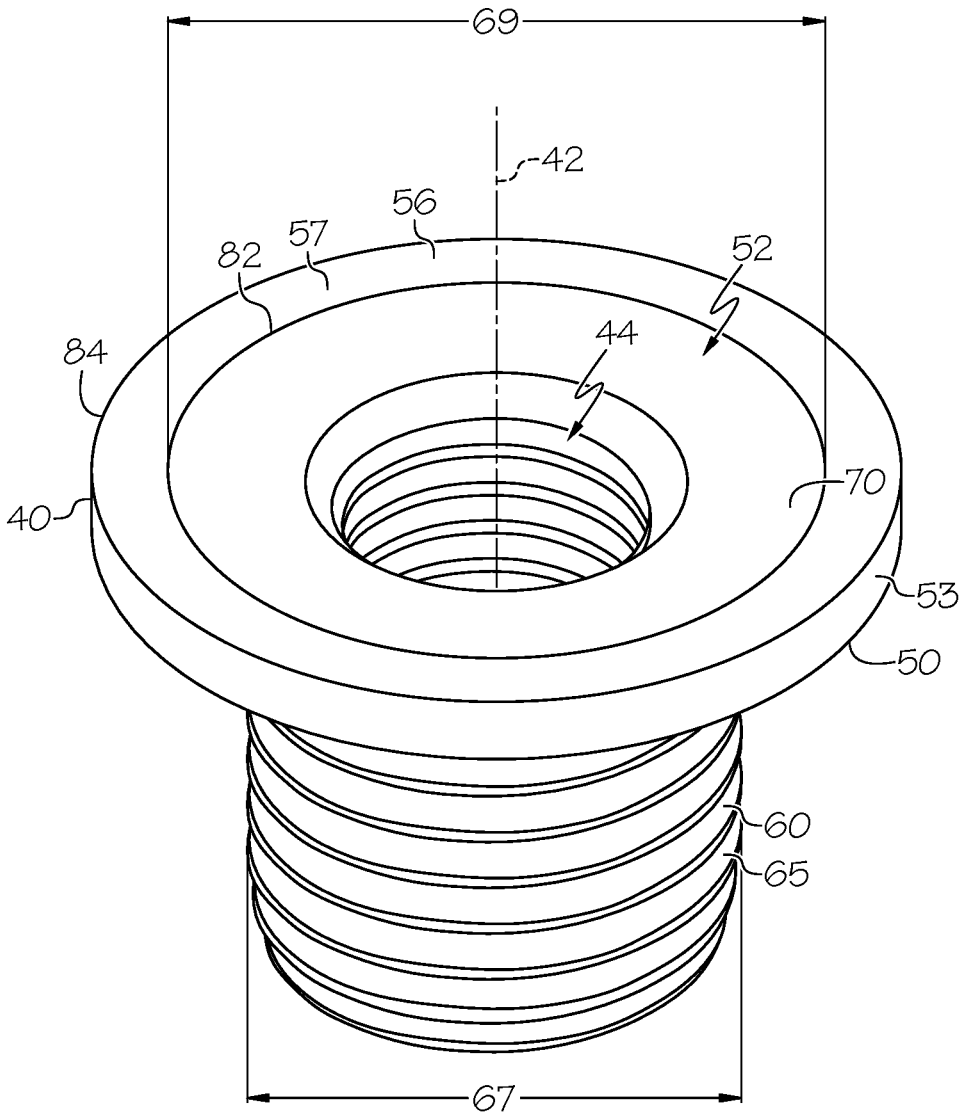
FIG. 5 shows an angled view of an embodiment of a bushing.
Figure 6:
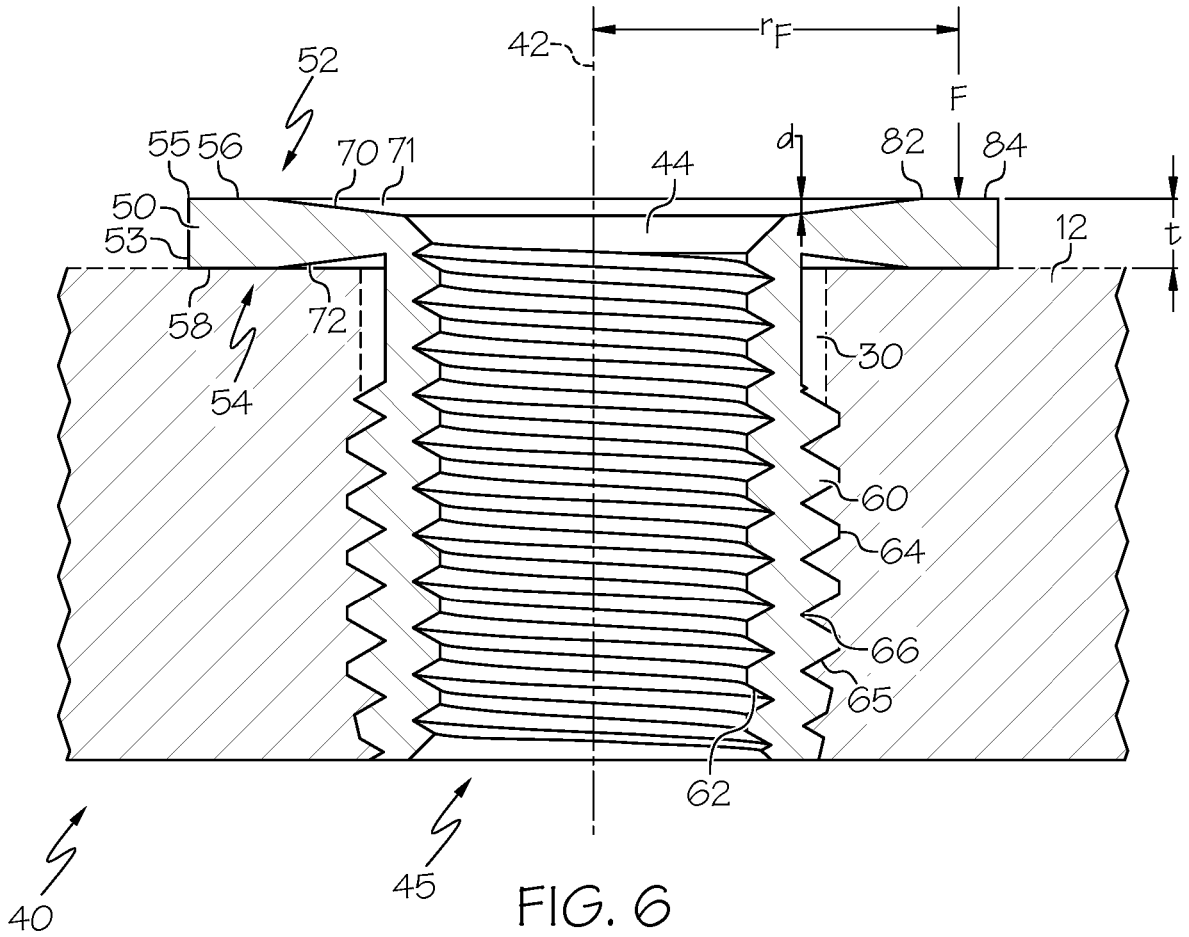
FIG. 6 shows a sectional view of an embodiment of a bushing.

FIGS. 3-5 show different views of an embodiment of a bushing 40, and FIG. 6 shows a sectional view.

In some embodiments, a bushing 40 comprises a shaft portion 60 and a flange 50. In some embodiments, the bushing 40 comprises an internal cavity 44. In some embodiments, the shaft portion 60 comprises a tubular shaft comprising a bore 45. In some embodiments, the bushing 40 comprises a central axis 42. In some embodiments, the bushing 40 is generally symmetrical about the central axis 42.

In some embodiments, the shaft portion 60 is arranged to extend into a riser 12. In some embodiments, the flange 50 is arranged to abut a surface of the riser 12.

In some embodiments, a bushing 40 is arranged to engage a supporting member, such as a riser 12. In some embodiments, the bushing 40 is arranged to engage a sidewall of a cavity 30 of the supporting member. In some embodiments, an outer surface of the shaft portion 60 comprises one or more protrusions 64 and/or one or more recesses 66. In various embodiments, protrusions 64 and recesses 66 can have any suitable shape. In some embodiments, the shaft portion 60 comprises external helical threads 65.

In some embodiments, an internal surface of the shaft portion 60 comprises protrusion(s) and/or recess(es). In some embodiments, an internal surface of the shaft portion 60 comprises internal helical threads 62.

In some embodiments, a distance across the flange 50 is greater than a distance across the shaft portion 60. In some embodiments, a diameter of the flange 50 is greater than a diameter of the shaft portion 60.

In some embodiments, the flange 50 comprises a front portion 52 and a rear portion 54. In some embodiments, the front portion 52 comprises a contacting surface 56 arranged to contact an accessory 11. In some embodiments, a contacting surface 56 is oriented orthogonal to the central axis 42. In some embodiments, a contacting surface 56 comprises at least three points arranged on a plane oriented orthogonal to the central axis 42. In some embodiments, a contacting surface 56 comprises a flat or planar surface. In some embodiments, a contacting surface 56 comprises a ring 57. In some embodiments, a ring 57 extends from an inner diameter 82 to an outer diameter 84.

In some embodiments, the contacting surface 56 comprises a front surface of the bushing 40 and all other portions of the bushing 40 are recessed behind the contacting surface 56. In some embodiments, the contacting surface 56 is oriented orthogonal to the central axis 42. In some embodiments, the front portion 52 comprises a recessed portion 70. In some embodiments, the recess 70 defines a cavity 71 extending behind the contacting surface 56. In some embodiments, the recessed portion 70 extends between the contacting surface 56 and the shaft portion 60. In some embodiments, the recessed portion 70 is arranged such that an accessory 11 that is supported by the bushing 40 will contact the contacting surface 56 but will not contact the recessed portion 70.

In some embodiments, the contacting surface 56 occupies an outer portion of the flange 50. In some embodiments, contacting surface 56 occupies an outer third of a radial dimension the bushing 40. In some embodiments, contacting surface 56 occupies an outer quarter of a radial dimension the bushing 40. In some embodiments, limiting the contacting surface 56 to an outer portion of the bushing 40 causes an external force F to be applied to the outer portion, which increases a radial distance $r_F$ between the central axis 42 and the external force F. In some embodiments, the increased radial distance $r_F$ can reduce the amount of external force F experienced by the bushing 40, for example when providing supporting moment forces to an attached accessory.

In some embodiments, the rear portion 54 comprises a rear surface 58 and a rear recess 72. In some embodiments, the rear recess 72 is oriented between the shaft portion 60 and the rear surface 58.

In some embodiments, the rear surface 58 is arranged to abut a supporting surface such as a riser 12. In some embodiments, the rear surface 58 is oriented orthogonal to the central axis 42. In some embodiments, the rear surface 58 is parallel to the contacting surface 56.

In some embodiments, the rear surface 58 is aligned with the contacting surface 56. In some embodiments, the rear surface 58 comprises dimensions that are similar to dimensions of the contacting surface 56 (e.g. radial dimension, inner diameter, outer diameter). In some embodiments, the rear recess 72 is aligned with the recessed portion 70. In some embodiments, the rear recess 72 comprises dimensions that are similar to dimensions of the recessed portion 70.

The recessed portion 70 can comprise any suitable shape. In some embodiments, the recessed portion 70 comprises a conical portion. In some embodiments, the recessed portion 70 comprises a frustoconical shape.

In some embodiments, the recessed portion 70 defines a cavity 71 that extends into the flange 50. In some embodiments, a depth d of the cavity 71 is at least 5% of a thickness t of the flange 50. In some embodiments, a depth d of the cavity 71 is at least 10% of the thickness t of the flange 50. In some embodiments, a depth d of the cavity 71 is at least 25% of the thickness t of the flange 50.

In some embodiments, the shaft portion 60 comprises an outer surface dimension 67. In some embodiments, the outer surface dimension 60 comprises an outer diameter of the shaft portion 60. In some embodiments, external helical threads 65 comprise the outer surface dimension 67.

In some embodiments, the contacting surface 56 comprises an inner dimension 69. In some embodiments, the inner dimension 69 comprises an inner diameter 82. In some embodiments, the inner dimension 69 of the contacting surface 82 is greater than an outer surface dimension 67 of the shaft portion 60. In some embodiments, the inner dimension 69 of the contacting surface 82 is greater than a size of the external helical threads 65. In some embodiments, an outer dimension of the recessed portion 70 is approximately equal to the inner dimension 69 of the contacting surface 82. In some embodiments, an outer dimension of the recessed portion 70 is greater than a size of the external helical threads 65.

In some embodiments, the flange 50 comprises a sidewall 53. In some embodiments, the sidewall 53 is oriented at an angle to the contacting surface 56. In some embodiments, the sidewall 53 is oriented perpendicular to the contacting surface 56. In some embodiments, the flange 50 comprises a radiused edge 55. In some embodiments, a radiused edge 55 is oriented between the contacting surface 56 and the sidewall 53. In some embodiments, a radius of the radiused edge 55 is less than half of a thickness t of the flange 50. In some embodiments, the radius of the radiused edge 55 is less than one-quarter of a thickness t of the flange 50.

In some embodiments, a bore 45 of the shaft portion 60 comprises a bore radial dimension $r_b$. In some embodiments, the recessed portion 70 comprises a recess radial dimension $r_r$. In some embodiments, the contacting surface 56 comprises a contact radial dimension $r_c$. In some embodiments, the recess radial dimension $r_r$ is greater than the contact radial dimension $r_c$. In some embodiments, the recess radial dimension $r_r$ can be less than the contact radial dimension $r_c$.

In some embodiments, a contacting surface 56 can have any suitable contact radial dimension $r_c$. In some embodiments, the contacting surface 56 comprises a relatively small total area. In some embodiments, the contacting surface 56 comprises a peak formed in the front portion 52 of the flange 50, and the contact radial dimension $r_c$ can be minimal.

In some embodiments, a sum of the contact radial dimension $r_c$ plus the recess radial dimension $r_c$ is greater than the bore radial dimension $r_b$.

In some embodiments, the contact radial dimension $r_c$ is less than one-half of a radius of the inner diameter 82. In some embodiments, the contact radial dimension $r_c$ is less than one-third of a radius of the inner diameter 82. In some embodiments, the contact radial dimension $r_c$ is less than one-quarter of a radius of the inner diameter 82.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser comprising a cavity;

a bushing comprising a single piece of material comprising a flange and a tubular shaft, the tubular shaft extending into the cavity, the tubular shaft comprising an internal helical thread, the flange comprising a front portion and a rear portion, the rear portion comprising a rear surface in contact with the riser, the front portion comprising a contacting surface and a recessed portion, the recessed portion oriented between the tubular shaft and the contacting surface.

2. The archery bow of claim 1, the tubular shaft comprising an external helical thread, the external helical thread engaging the cavity.

3. The archery bow of claim 2, wherein a distance across the recessed portion is greater than a distance across the external helical thread.

4. The archery bow of claim 2, wherein a diameter of the recessed portion is greater than a diameter of the external helical thread.

5. The archery bow of claim 1, the rear surface parallel to the contacting surface.

6. The archery bow of claim 1, the contacting surface comprising a ring.

7. The archery bow of claim 6, wherein an inner diameter of the ring is greater than a distance across the external helical thread.

8. The archery bow of claim 1, the flange comprising an outer sidewall oriented at an angle to the contacting surface.

9. The archery bow of claim 8, the flange comprising a radiused edge oriented between the contacting surface and the outer sidewall, the flange comprising a thickness, wherein a radius of the radiused edge is less than half of the thickness.

10. The archery bow of claim 1, the recessed portion comprising a frustoconical surface.

11. The archery bow of claim 1, wherein a radial dimension of the recessed portion is greater than a radial dimension of the contacting surface.

12. An archery bow comprising:

a riser comprising a cavity;

a bushing comprising a flange and a tubular shaft, the tubular shaft extending into the cavity, the tubular shaft comprising an internal helical thread, the flange comprising a front portion and a rear portion, the rear portion comprising a rear surface in contact with the riser, the front portion comprising a contacting surface and a recessed portion, the recessed portion oriented between the tubular shaft and the contacting surface;

the rear portion comprising a rear recess oriented between the tubular shaft and the rear surface.

13. The archery bow of claim 12, the rear recess oriented opposite the recessed portion.

14. An archery bow comprising:

a riser and a bushing attached to the riser;

the bushing comprising a single piece of material comprising a flange and a tubular shaft, the tubular shaft comprising an external helical thread and an internal helical thread, the flange comprising a front portion and a rear portion, the rear portion comprising a rear surface in contact with the riser, the front portion comprising a recessed portion and a contacting ring, wherein a diameter of the contacting ring is greater than a distance across the external helical thread.

15. The archery bow of claim 14, the contacting ring comprising an inner diameter and an outer diameter, the inner diameter greater than the distance.

16. The archery bow of claim 14, the recessed portion oriented between the tubular shaft and the contacting ring.

17. The archery bow of claim 14, the rear portion comprising a rear recess oriented between the tubular shaft and the rear surface.

18. The archery bow of claim 17, the rear recess oriented opposite the recessed portion.

* * * * *